US009630752B2

(12) United States Patent
Kooney

(10) Patent No.: US 9,630,752 B2
(45) Date of Patent: Apr. 25, 2017

(54) PLIABLE VARIABLE DIAMETER SEALING LID

(76) Inventor: Christianna Mikhal Kooney, Slidell, LA (US)

( * ) Notice: Subject to any disclaimer, the term of this patent is extended or adjusted under 35 U.S.C. 154(b) by 0 days.

(21) Appl. No.: 13/369,268

(22) Filed: Feb. 8, 2012

(65) Prior Publication Data

US 2012/0318815 A1 Dec. 20, 2012

Related U.S. Application Data

(60) Provisional application No. 61/498,097, filed on Jun. 17, 2011.

(51) Int. Cl.
*B65D 41/16* (2006.01)
*B65D 43/02* (2006.01)

(52) U.S. Cl.
CPC ..... *B65D 41/165* (2013.01); *B65D 43/0212* (2013.01); *B65D 2251/02* (2013.01); *B65D 2543/0037* (2013.01); *B65D 2543/00222* (2013.01); *B65D 2543/00527* (2013.01); *B65D 2543/00537* (2013.01); *B65D 2543/00842* (2013.01)

(58) Field of Classification Search
CPC .. B65D 2543/0222; B65D 2543/00527; B65D 2543/00537; B65D 2543/00842; B65D 2543/0074; B65D 2543/0037; B65D 41/165; B65D 43/0212; B65D 43/0222; B65D 2251/02
USPC ..... 220/287, 796, 805, DIG. 19, 793; 138/89; 215/305
See application file for complete search history.

(56) References Cited

U.S. PATENT DOCUMENTS

| | | | | | |
|---|---|---|---|---|---|
| 1,934,681 | A * | 11/1933 | Damsel | 138/96 R | |
| 2,266,270 | A * | 12/1941 | Roth | 215/317 | |
| 2,630,237 | A * | 3/1953 | Rosenlof | 220/793 | |
| 3,559,843 | A * | 2/1971 | Kern | 220/281 | |
| 4,180,178 | A * | 12/1979 | Turner | 220/281 | |
| 4,709,832 | A * | 12/1987 | Mantyla | 220/780 | |
| 4,799,716 | A * | 1/1989 | Kujawa et al. | 285/334.2 | |
| 4,815,628 | A * | 3/1989 | Wehnert, III | 220/796 | |
| 5,452,818 | A * | 9/1995 | Yost | 220/258.2 | |
| 2006/0060584 | A1* | 3/2006 | Onoda | 220/287 | |
| 2006/0091100 | A1* | 5/2006 | Geho | B65D 41/48 215/305 | |
| 2012/0038151 | A1* | 2/2012 | Bernard et al. | 285/363 | |

* cited by examiner

*Primary Examiner* — James N Smalley
(74) *Attorney, Agent, or Firm* — Dunlap Bennett & Ludwig PLLC

(57) ABSTRACT

A single piece sealing lid is made of a soft, flexible material that allows the lid to cover and reseal an opened food can. The flexible lip seal may have such a length so as to allow it to seal against the outside circumference of the can, below the can lid ridge. Since the flexible lip of the sealing lid is flexible, it can accommodate cans of varying diameter and does not require the can opening to be perfectly round. Therefore, the sealing lid may fit damaged or out-of round can openings. A pull tab may be provided on the sealing lid to assist in the installation and removal of the sealing lid from a can.

2 Claims, 1 Drawing Sheet

PLIABLE VARIABLE DIAMETER SEALING LID

CROSS-REFERENCE TO RELATED APPLICATIONS

This application claims the benefit of priority of U.S. provisional patent application No. 61/498,097, filed Jun. 17, 2011, the contents of which are herein incorporated by reference.

BACKGROUND OF THE INVENTION

The present invention relates to container seals and, more particularly, to a pliable lip seal lid for resealing variable diameter containers, such as food containing cans.

Covering opened food cans of varying dimensions and conditions for temporary refrigeration storage is difficult in both installation and removal. Presently available food can resealing lids are designed with a sealing feature that is specific to a certain food can diameter. Such lids may not seal other can diameters, if they fit at all. Moreover, such lids cannot seal cans with damaged or out-of-round openings.

As can be seen, there is a need for an improved lid for resealing variable diameter containers.

SUMMARY OF THE INVENTION

In one aspect of the present invention, a sealing lid assembly comprises a lid top portion; a lid top portion edge extending from an outer circumference of the lid top portion; a variable diameter sealing portion extending from the lid top portion edge and extending toward a center point of the lid top portion; and a pull tab extending away from an edge of the lid top portion.

In another aspect of the present invention, a sealing lid assembly comprises a lid top portion; a lid top portion edge extending from an outer circumference of the lid top portion; a variable diameter sealing portion extending from the lid top portion edge and extending toward a center point of the lid top portion; and a pull tab extending away from an edge of the lid top portion, wherein the variable diameter sealing portion defines a minimum diameter that is from about 5% to about 30% smaller than a diameter of the lid top portion, and the sealing lid assembly is a single-piece integral unit.

These and other features, aspects and advantages of the present invention will become better understood with reference to the following drawings, description and claims.

DETAILED DESCRIPTION OF THE INVENTION

Figure 1:
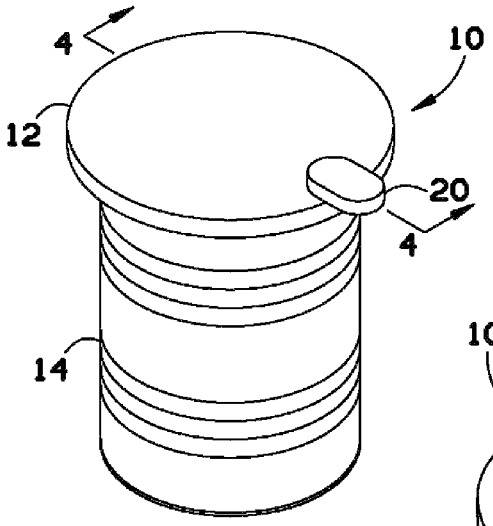
FIG. 1 is a perspective view of a sealing lid, attached to a can, according to an exemplary embodiment of the present invention.
Figure 2:
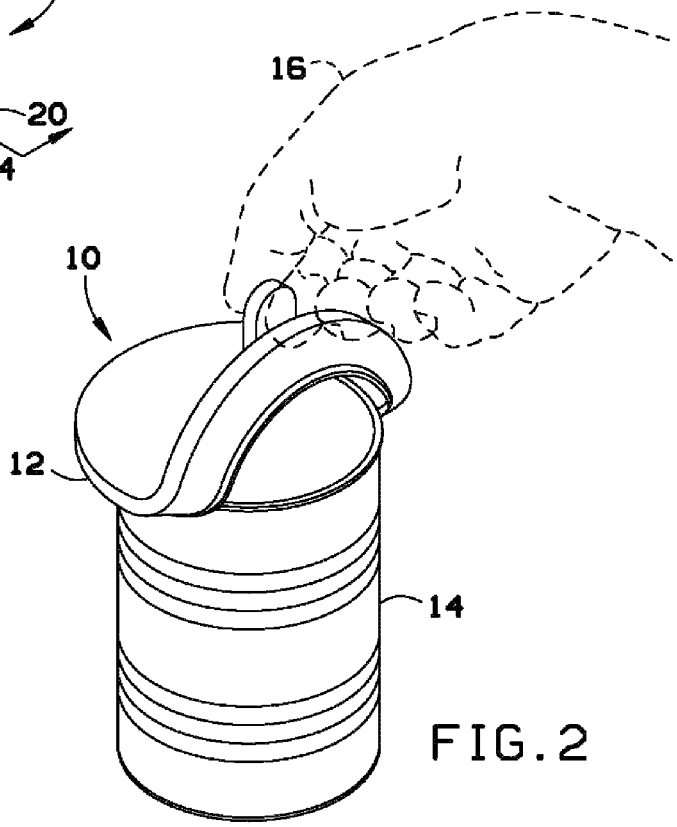
FIG. 2 is a perspective view of the sealing lid of FIG. 1, showing installation on a can.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a single piece sealing lid made of a soft, flexible material that allows the lid to cover and reseal an opened food can. The flexible lip seal may have such a length so as to allow it to seal against the outside circumference of the can, below the can lid ridge. Since the flexible lip of the sealing lid is flexible, it can accommodate cans of varying diameter and does not require the can opening to be perfectly round. Therefore, the sealing lid may fit damaged or out-of round can openings. A pull tab may be provided on the sealing lid to assist in the installation and removal of the sealing lid from a can.

Referring now to FIGS. 1 through 4, a sealing lid assembly 10 may include a lid top portion 22 having a pull tab 20 attached thereto. The lid top portion 22 may be round. In some embodiments the lid top portion 22 may be made integrally and of the same material of the entire sealing lid assembly 10. In some embodiments, the lid top portion 22 may be made of a soft, pliable, flexible material, allowing flex should the can be overfilled. In some embodiments, the lid top portion 22 may be made of a material different from the remainder of the sealing lid assembly 10. As discussed below, the diameter of the lid top portion 22 may define a maximum diameter opening for a can 14 to be sealed. While the sealing lid assembly 10 may still seal a can having a diameter larger than the lid top portion 22, such a connection may not be as secure as when the can's opening is equal to or smaller than the diameter of the lid top portion 22.

A lid top portion edge 12 may extend generally perpendicular to the lid top portion 22 about its circumference. The lid top portion edge 12 may be made of the same material as the lid top portion 22.

Figure 3:
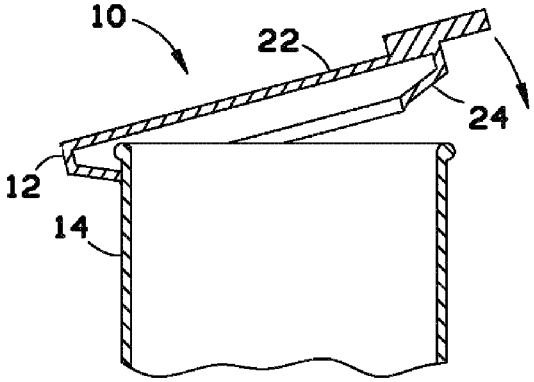
FIG. 3 is a cross sectional view of the sealing lid of FIG. 1, showing installation on a can.
Figure 4:
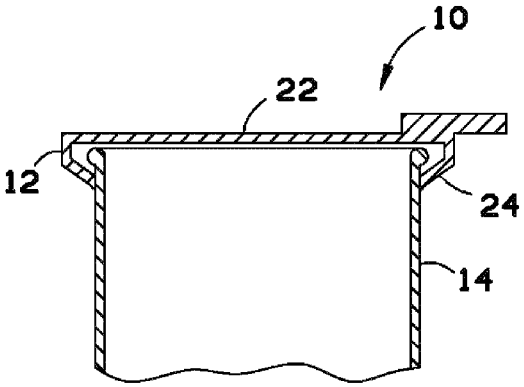
FIG. 4 is a cross sectional view taken along line 4-4 of FIG. 1, showing the sealing lid installed on a can.

A variable diameter sealing portion 24 (also referred to as sealing portion 24) may extend inward toward the center of the lid top portion 22. As shown in FIGS. 3 and 4, as the sealing lid assembly 10 is applied to the can 14, the sealing portion 24 may be disposed below the can opening, at an outer circumference of the can. A user may pull the tab 20 to stretch the sealing portion 24 over the opening of the can 14 to cover the opening as shown in FIGS. 1 and 4.

As discussed in the above paragraph, the sealing portion 24 extends inward toward the center of the lid top portion 22. In some embodiments the sealing portion 24 may extend toward the center of the lid top portion 22 to form an inside diameter that is from about 5% to about 30% smaller than the diameter of the lid top portion 22. This configuration permits the sealing lid assembly 10 to seal cans having diameters from the inside diameter of the sealing portion 24 to the diameter of the lid top portion 22. Typically, this configuration will provide a variability from about 1 inch to about 4 inches in the diameter of the can's opening that the sealing lid assembly 10 may attach. For example, a sealing lid assembly 10 may fit cans from about 3 inches in diameter to about 6 inches in diameter.

The sealing lid assemblies 10 may be made in various sizes. A set of sealing lid assemblies may be designed to cover openings from about 1 inch to about 12 inches or greater. The sealing lid assemblies 10 may be made of a soft, pliable material, such as rubber, silicone, or the like.

While the above description discusses the sealing lid assembly working to seal a can opening, such as a food or pet food can, the sealing lid assembly may be used to close and seal other items, such as bottles, storage containers, or the like.

It should be understood, of course, that the foregoing relates to exemplary embodiments of the invention and that modifications may be made without departing from the spirit and scope of the invention as set forth in the following claims.

What is claimed is:

1. An assembly comprising:

a sealing lid comprising:

a lid top portion comprising a round shape and having a planar upper surface;

a lid top portion edge extending perpendicular from an outer circumference of the lid top portion, wherein the lid top portion edge comprises a cylinder shape;

a sealing portion extending from the lid top portion edge and extending toward a longitudinal axis extending through a center point of the lid top portion at an angle away from the lid top portion and comprising a lower edge having a variable diameter, the sealing portion forming a frusto-conical shape;

a pull tab attached to the planar upper surface of the lid top portion and extending beyond the lid top portion edge, wherein the pull tab comprises a planar top surface disposed above and parallel to the planar upper surface of the lid top portion; and a storage container comprising a transverse bottom wall and a sidewall extending from the base forming an internal space within, wherein the sidewall comprises an upper rim forming an opening into the internal space of the storage container, wherein the sealing lid assembly is formed from a soft, pliable, flexible material and releasably secures to the upper rim, thereby covering the opening of the container in a sealed position so that the internal space is completely enclosed, wherein the variable diameter varies from substantially smaller than a sidewall diameter in a non-sealed position to equal to the sidewall diameter in the sealed position, wherein a gap is formed in between the lid top portion edge, the sealing portion and the storage container in the sealed position.

2. A sealing lid comprising:

a lid top portion having a planar upper surface comprising a round shape;

a lid top portion edge extending perpendicular from an outer circumference of the lid top portion, wherein the lid top portion edge comprises a cylinder shape;

a sealing portion extending from the lid top portion edge and extending toward a longitudinal axis extending through a center point of the lid top portion at an angle away from the lid top portion and comprising a lower edge having a variable diameter, the sealing portion forming a frusto-conical shape; and a pull tab attached to the planar upper surface of the lid top portion, wherein the pull tab comprises an elongated circle shape comprising a rounded end extending beyond the lid top portion edge, wherein the pull tab comprises a planar top surface disposed above and parallel to the planar upper surface of the lid top portion.

* * * * *